US007328569B2

(12) United States Patent
Schweier

(10) Patent No.: US 7,328,569 B2
(45) Date of Patent: Feb. 12, 2008

(54) ARRANGEMENT FOR PRODUCING A SPUN THREAD FROM A STAPLE FIBER STRAND

(75) Inventor: Peter Schweier, Geislingen/Steige (DE)

(73) Assignee: Maschinenfabrik Rieter Ag, Winterthur (CH)

( * ) Notice: Subject to any disclaimer, the term of this patent is extended or adjusted under 35 U.S.C. 154(b) by 0 days.

(21) Appl. No.: 10/582,358

(22) PCT Filed: Oct. 15, 2004

(86) PCT No.: PCT/EP2004/011589

§ 371 (c)(1),
(2), (4) Date: Jun. 9, 2006

(87) PCT Pub. No.: WO2005/061765

PCT Pub. Date: Jul. 7, 2005

(65) Prior Publication Data

US 2007/0107411 A1 May 17, 2007

(30) Foreign Application Priority Data

Dec. 11, 2003 (DE) ..... 103 58 484

(51) Int. Cl.
*D01H 7/00* (2006.01)

(52) U.S. Cl. ..... 57/350

(58) Field of Classification Search ..... 57/315, 57/333, 350, 400, 403
See application file for complete search history.

(56) References Cited

U.S. PATENT DOCUMENTS 4,107,911 A * 8/1978 Yamana et al. ..... 57/304
4,412,413 A 11/1983 Sakai et al.
5,390,485 A * 2/1995 Mori ..... 57/328
5,560,194 A * 10/1996 Shofner et al. ..... 57/264
5,694,759 A * 12/1997 Caviness ..... 57/408
5,699,659 A * 12/1997 Caviness ..... 57/245
6,295,800 B1 * 10/2001 Stahlecker ..... 57/411

FOREIGN PATENT DOCUMENTS

DE 1 945 915 9/1966
DE 103 11 826 A1 9/2004
EP 0 807 699 A2 11/1997
EP 1 207 225 A2 5/2002
JP 4-343717 A 11/1992

OTHER PUBLICATIONS

International Search Report dated Feb. 4, 2005 including English Translation (Six (6) pages).

* cited by examiner

*Primary Examiner*—Shaun R. Hurley
(74) *Attorney, Agent, or Firm*—Crowell & Moring LLP

(57) ABSTRACT

An arrangement for producing a spun thread includes a drafting unit having a delivery roller pair and an airjet assembly arranged downstream thereof. In the airjet assembly, a vortex chamber with an air evacuation channel is provided. Furthermore, at least one cleaning channel is provided, which is arranged with a suction opening to the delivery roller pair. This cleaning channel is connected by a mouthpiece to the air evacuation channel. A compressed air opening of an injector channel is located in the area of the mouthpiece. The injector channel increasing the low pressure of the air evacuation channel when required.

10 Claims, 2 Drawing Sheets

ARRANGEMENT FOR PRODUCING A SPUN THREAD FROM A STAPLE FIBER STRAND

BACKGROUND AND SUMMARY OF THE INVENTION

The present invention relates to an arrangement for producing a spun thread from a staple fiber strand, comprising a drafting unit having a delivery roller pair, also comprising an airjet assembly arranged downstream thereof, which airjet assembly comprises a vortex chamber having an air evacuation channel, also comprising at least one cleaning channel, which is arranged with a suction opening to the delivery roller pair.

An arrangement of this type is prior art in European published patent application 1 207 225. In the case of this arrangement, a staple fiber strand is drafted in a drafting unit to a thin fiber strand, to which the spinning twist is then imparted in the airjet assembly. For this, the fiber strand is first fed through an entry channel of the airjet assembly into a vortex chamber, to which a fluid device is assigned for generating a vortex stream around an entry opening of a thread withdrawal channel. The front ends of the fibers held in the fiber strand are thereby initially fed into the thread withdrawal channel, while rear free fiber ends spread out, are seized by the vortex current, and are twined around the front ends already located in the entry opening of the thread withdrawal channel, that is, around the front ends already intertwined, by means of which a thread having, to a large extent, a real twist is formed.

An arrangement of this type permits high spinning speeds, while placing high demands primarily on the drafting unit arranged upstream of the airjet assembly. In particular, the especially fast rotating delivery roller pair is subject to fiber fly deposits on its peripheral surfaces. For this reason, a suction opening of a cleaning channel is operatively arranged with respect to the delivery roller pair of the known arrangement, which cleaning channel ensures that the delivery roller pair is kept clean. The above mentioned publication does not disclose to which vacuum source the cleaning channel is connected, but it can be seen from the patent drawings that different vacuum sources are clearly provided for the air evacuation channel and the cleaning channel.

It is an object of the present invention to provide a particularly simple design for an arrangement of the above mentioned type, and furthermore to intensify the cleaning process when required.

This object has been achieved in that the cleaning channel is connected to the air evacuation channel via a mouthpiece, and that in the area of the mouthpiece, a compressed air opening of an injector channel for increasing the low pressure in the air evacuation channel, when required, is provided.

Because the cleaning channel is connected to the air evacuation channel with a mouthpiece, a joint fan for the waste air sucked out of the vortex chamber and for the cleaning of the delivery roller pair can be used, which leads to a significantly reduced complexity in the manufacturing process in comparison to the prior art. Because a compressed air opening of an injector channel for increasing the low pressure in the air evacuation channel when required is provided in the area of the mouthpiece, the low pressure can be temporarily increased, and even almost doubled, for the purposes of intensifying the cleaning process. This is possible without increasing the capacity of the fan. The injector channel can retroact with maximum effect up to the suction opening, as it runs in with its compressed air opening at a particularly effective point. The suction action can thus be increased for periodical cleaning by periodically activating the injector channel when required, particularly in the case of an interruption in the spinning process and a subsequent piecing process. The increased effect is particularly high when the cleaning channel extends straight-lined between its suction opening and its mouthpiece, and when it preferably measures a maximum length of 20 mm.

In an advantageous embodiment of the present invention, it is provided that the airjet assembly, together with the cleaning channel, can be swivelled in relation to the delivery roller pair in such a way that the suction opening can be positioned to the area of the wedge-shaped gap formed by the delivery roller pair. After an interruption in the spinning process, when a thin fiber strand is again fed through the drafting unit to the airjet assembly, an initially inhomogenous fiber stream is deflected from its normal transport direction, namely through the suction opening of the cleaning channel. The fiber strand is initially removed as waste, until a homogenous fiber stream is achieved, whereafter the increase in outgoing air effected by the injector channel can be cut off again. The swiveling capacity permits the suction opening of the cleaning channel to be directed not only against a peripheral surface of the delivery roller pair, but rather directly into the wedge-shaped gap of the delivery roller pair, from which wedge-shaped gap the thin fiber strand is supplied.

It is known from European published patent application 0 807 699 that in connection with a piecing process, a fed fiber strand is temporarily deflected, which in this case, however, occurs via an additional suction tube, which is located between the delivery roller pair and the airjet assembly.

These and further objects, features and advantages of the present invention will become more readily apparent from the following detailed description of an arrangement shown both enlarged and in schematic cross-sectional form.

DETAILED DESCRIPTION OF THE DRAWINGS

Figure 1:
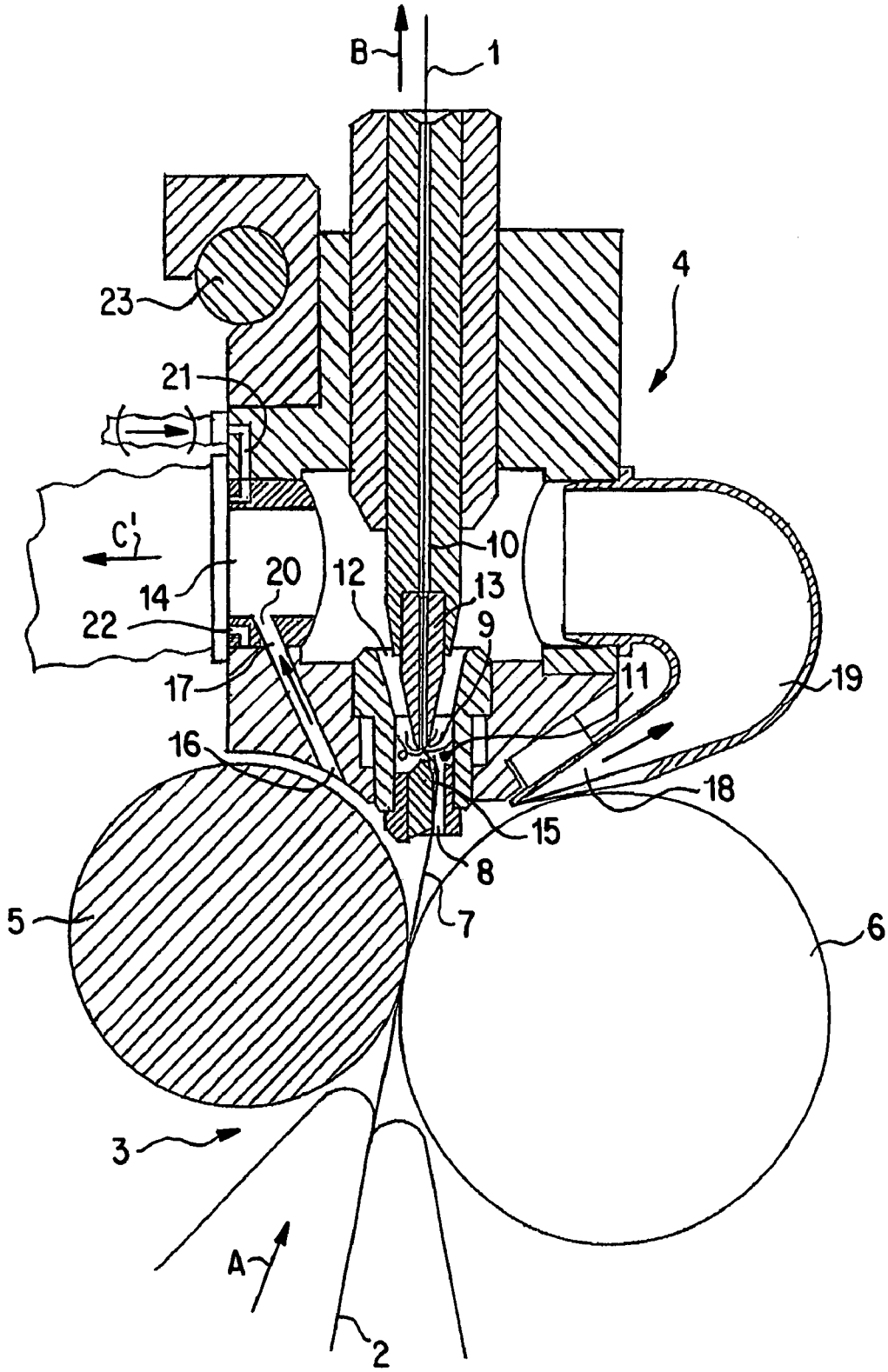
FIG. 1 is a cross-sectional view of an arrangement for producing a spun thread according to the present invention.

The arrangement shown in FIG. 1 serves to produce a spun thread 1 from a staple fiber strand 2. The arrangement comprises as essential components a drafting unit 3 and an airjet assembly 4.

The staple fiber strand 2 to be spun is fed to the drafting unit 3 in feed direction A and is withdrawn as a spun thread 1 in withdrawal direction B. It is then fed further to a winding device (not shown). The only partly shown drafting unit 3 is advantageously designed as a three cylinder drafting unit and includes three roller pairs overall, each of which includes a driven bottom roller and an upper roller in the form of a pressure roller. A delivery roller pair 5,6 is arranged downstream of the first two roller pairs (not shown), of which delivery roller pair 5,6, the delivery roller 5 is a driven bottom roller and the delivery roller 6 is a pressure roller. In a drafting unit of this kind, the staple fiber strand 2 is drafted in the known way to the desired degree of fineness. Directly downstream of the drafting unit 3, a thin fiber strand 7 is present, which is drafted but still twist-free.

The airjet assembly 4, which imparts the spinning twist, and is arranged downstream of the drafting unit 3 at a short distance therefrom, can in the case of the present invention correspond to the arrangement described in the above mentioned publication.

The thin fiber strand 7 is fed to the airjet assembly 4 via an entry channel 8. Downstream thereof is a so-called vortex chamber 9, in which the fiber strand 7 is imparted its spinning twist, so that a spun thread 1 occurs, which is then withdrawn through a thread withdrawal channel 10.

A fluid device generates a vortex current in the vortex chamber 9 by blowing compressed air through compressed air nozzles 11, which run tangentially into the vortex chamber 9. The compressed air exiting out of the nozzle openings are fed through an air evacuation channel 12, whereby this channel 12 includes initially a ring-shaped cross section around a spindle-shaped stationary component 13. The stationary component 13 includes the thread withdrawal channel 10. The evacuation channel 12 then graduates into a larger suction channel 14 having a suction direction C.

In the area of the vortex chamber 9, the edge of a fiber guiding surface 15 is arranged as a twist block. The fiber guiding surface 15 extends slightly excentrically to the thread withdrawal channel 10 in the area of its entry opening.

In the arrangement, the fibers to be spun are held on the one hand in fiber strands 7, and fed from the entry channel 8 essentially without twist into the thread withdrawal channel 10. On the other hand, the fibers in the area between the entry channel 8 and the thread withdrawal channel 10 are subject to the action of the vortex current, which drives the fibers away radially, or at least their end areas, from the entry opening of the thread withdrawal channel 10. The threads 1 produced by means of the described process show a core of fibers or fiber areas essentially extending in thread longitudinal direction without any significant twist, and an outer area, in which the fibers or fiber areas are twined around the core.

This composition of fibers is formed, according to an idealized process for the purposes of greater clarity, in that the front ends of fibers, in particular those whose rear areas are still held upstream in the entry channel 8, essentially get into the thread withdrawal channel 10 directly, but that rear fiber ends, in particular when they are no longer held in the entry area of the entry channel 8, are pulled out of the fiber strand 7 by the vortex current and are then twined around the forming thread 1. In any case, fibers are simultaneously intertwined in the forming thread 1, which results in the fibers being pulled through the thread withdrawal channel 10, and subjected to the vortex current, which results in the fibers being centrifugally accelerated, that is, accelerated away from the entry opening of the thread withdrawal channel 10, and being withdrawn in the air evacuation channel 12. The fiber areas pulled out of the fiber strand 1 due to the vortex current form a fiber vortex, the so-called "sun", which runs into the entry opening of the thread withdrawal channel 10. The longer parts of the fiber vortex wind themselves around on the spindle-shaped entry area of the thread withdrawal channel 10 and are pulled, in this spiral, against the force of the air stream in the air evacuation channel 12 into the entry opening of the thread withdrawal channel 10.

An arrangement of this type permits particularly high spinning speeds, which can lie in the range of 600 meters per minute. It is obvious that very high demands are hereby placed on the drafting unit 3, as the delivery roller pair 5,6 must rotate very rapidly due to the required high drafting performance. This results, inevitably, in the delivery roller pair 5,6 being subject to heavy fly accumulation caused by waste fibers. For this reason, a suction opening 16 of a cleaning channel 17 is operatively arranged with respect to the bottom roller of the delivery roller pair 5, 6, and a second suction opening 18 of a further cleaning channel 19 operatively is arranged with respect to the pressure roller 6.

In contrast to the prior art described above, both cleaning channels 17 and 19 run into the inside of the airjet assembly 4 in the air evacuation channel 12, and into its extension, the suction channel 14, respectively.

As can be seen, the cleaning channel 17 arranged to the bottom roller 5 extends straight-lined and slightly tangentially to the bottom roller 5 and is preferably not longer than 20 mm.

According to the present invention, at least the cleaning channel 17 with its mouthpiece 20 is connected to the air evacuation channel 12, 14, whereby in the area of the mouthpiece 20 a compressed air opening 22 of an injector channel 21, which increases the low pressure in the air evacuation channel 12, 14 when required, is provided. The effect in the air evacuation channel 12 can be temporarily and significantly increased, for example, in order to momentarily clean the surfaces of the delivery rollers 5, 6 when the spinning process has been interrupted. During the normal spinning process, an airstream is continuously present via the cleaning channels 17 and 19, which airstream deans the delivery roller pair 5, 6, while the injector channel 21 is activated only periodically, and in particular only during an interruption in the spinning process. Because the compressed air opening 22 of the injector channel 21 is located in the area of the mouthpiece 20 of one cleaning channel 17, the effect on this cleaning channel 17 is particularly great.

Figure 2:
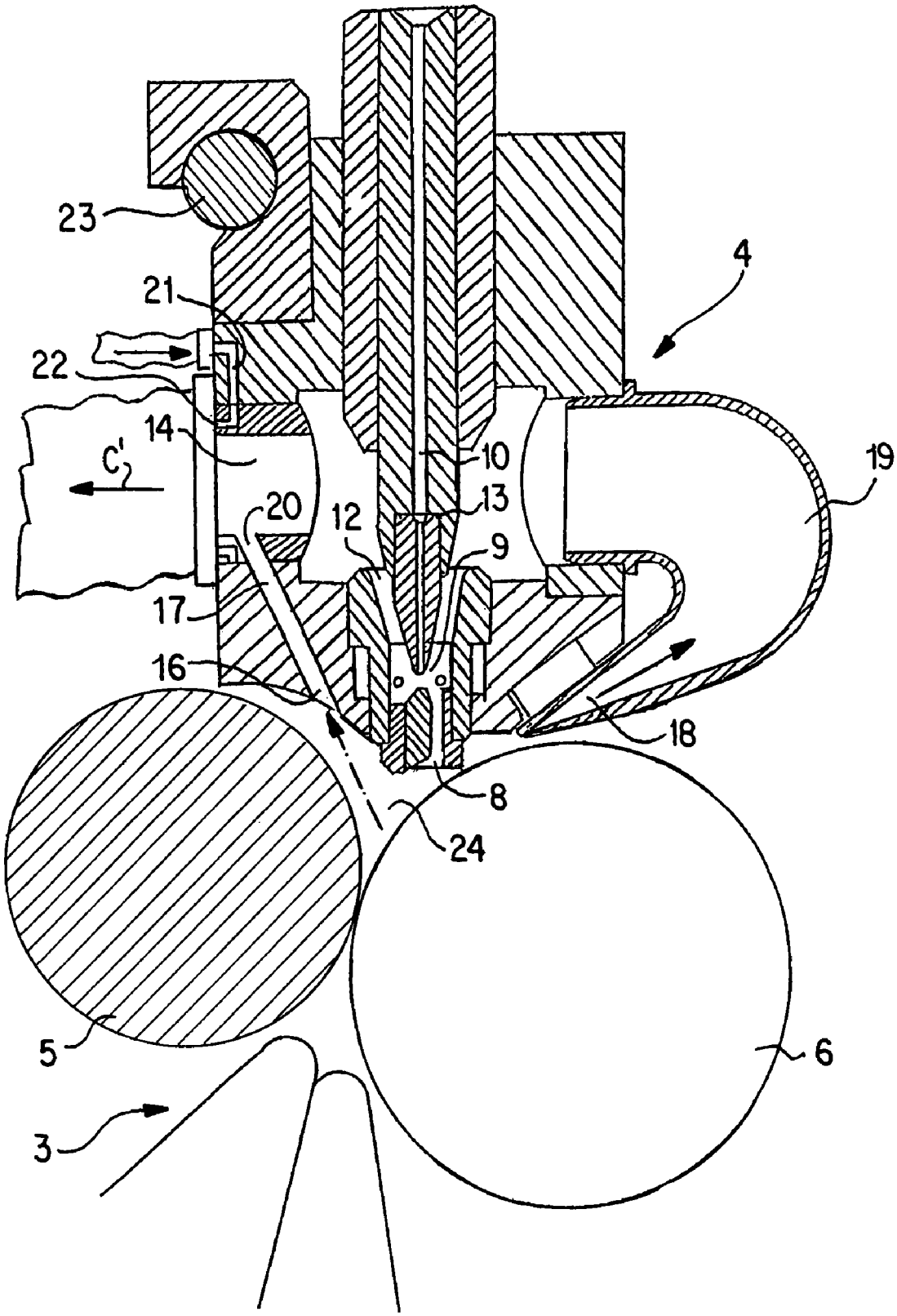
FIG. 2 is a cross-sectional diagram in accordance with FIG. 1 showing a swiveling of the airjet assembly in accordance with the present invention.

As can be seen in particular in FIG. 2, the airjet assembly 4 can be somewhat swivelled during an interruption in the spinning process, so that the suction opening 16 of the cleaning channel 17 can be directed against the wedge-shaped gap 24 of the delivery roller pair 5, 6. For this purpose, the swivel axle 23 for the airjet assembly 4 is geometrically arranged accordingly. A cleaning channel 17 which is as linear and as short as possible increases hereby the effect.

As shown by the dot-dash arrow in FIG. 2, an initially inhomogenous fiber stream delivered by the drafting unit 3 during a piecing process can be deflected via the cleaning channel 17 directly into the air evacuation channel 14. Only then when a homogenous fiber stream is again delivered, and the compressed air fed via the injector channel 21 is cut off, can the thin fiber strand 7 be fed again to the operational entry channel 8. Thus, by means of the characteristics of the present invention, not only the cleaning of the delivery roller pair 5, 6 can be intensified, but at the same time, if required, a fiber stream deflection for the purposes of the piecing process can be achieved.

The invention claimed is:

1. An arrangement for producing a spun thread from a staple fiber strand, comprising:

a drafting unit having a delivery roller pair;

an airjet assembly arranged downstream of the drafting unit, which airjet assembly comprises a vortex chamber having an air evacuation channel, and at least one cleaning channel, which cleaning channel has a suction opening operatively arranged with respect to the delivery roller pair;

wherein the cleaning channel is connected to the air evacuation channel with a mouthpiece, and further wherein in an area of the mouthpiece, a compressed air opening of an injector channel for increasing a low pressure of the air evacuation channel when required, is provided.

2. The arrangement according to claim 1, wherein the cleaning channel extends straight-lined from the suction opening to the mouthpiece.

3. An arrangement for producing a spun thread from a staple fiber strand, comprising:

a drafting unit having a delivery roller pair;

an airjet assembly arranged downstream of the drafting unit, which airjet assembly comprises a vortex chamber having an air evacuation channel, and at least one cleaning channel, which cleaning channel has a suction opening operatively arranged with respect to the delivery roller pair;

wherein the cleaning channel is connected to the air evacuation channel with a mouthpiece, and further wherein in an area of the mouthpiece, a compressed air opening of an injector channel for increasing a low pressure of the air evacuation channel when required, is provided; and wherein the cleaning channel has a maximum length of 20 mm.

4. The arrangement according to claim 3, wherein the cleaning channel extends straight-lined from the section opening to the mouthpiece.

5. An arrangement for producing a spun thread from a staple fiber strand, comprising:

a drafting unit having a delivery roller pair;

an airjet assembly arranged downstream of the drafting unit, which airjet assembly comprises a vortex chamber having an air evacuation channel, and at least one cleaning channel, which cleaning channel has a suction opening operatively arranged with respect to the delivery roller pair;

wherein the cleaning channel is connected to the air evacuation channel with a mouthpiece, and further wherein in an area of the mouthpiece, a compressed air opening of an injector channel for increasing a low pressure of the air evacuation channel when required, is provided; and wherein the airjet assembly, together with the cleaning channel, are swivellable in relation to the delivery roller pair such that the suction opening is positionable with respect to an area of a wedge-shaped gap formed by the delivery roller pair.

6. The arrangement according to claim 5, wherein the cleaning channel extends straight-lined from the suction opening to the mouthpiece.

7. The arrangement according to claim 3, wherein the airjet assembly, together with the cleaning channel, are swivellable in relation to the delivery roller pair such that the suction opening is positionable with respect to an area of a wedge-shaped gap formed by the delivery roller pair.

8. An airjet assembly for use with a drafting unit having a delivery roller pair to produce a spun thread from a staple fiber strand, the airjet assembly comprising:

a vortex chamber having an air evacuation channel;

at least one cleaning channel having a suction opening at one end and a mouthpiece at another end, the suction opening being operatively arranged adjacent to the delivery roller pair of the drafting unit when in use, wherein the mouthpiece of the cleaning channel opens into the air evacuation channel; and a compressed air opening of an injector channel arranged in an area of the mouthpiece, whereby the compressed air opening increases a low pressure of the air evacuation channel when required.

9. The airjet assembly according to claim 8, wherein the cleaning channel is substantialiy straight between the suction opening and the mouthpiece.

10. An airjet assembly for use with a drafting unit having a delivery roller pair to produce a spun thread from a staple fiber strand, the airjet assembly comprising:

a vortex chamber having an air evacuation channel;

at least one cleaning channel having a suction opening at one end and a mouthpiece at another end, the suction opening being operatively arranged adjacent to the delivery roller pair of the drafting unit when in use, wherein the mouthpiece of the cleaning channel opens into the air evacuation channel;

a compressed air opening of an injector channel arranged in an area of the mouthpiece, whereby the compressed air opening increases a low pressure of the air evacuation channel when required;

wherein the cleaning channel is substantially straight between the suction opening and the mouthpiece; and wherein the cleaning channel has a maximum length of 20 mm.

* * * * *